US008723112B2

(12) United States Patent
Kim et al.

(10) Patent No.: US 8,723,112 B2
(45) Date of Patent: May 13, 2014

(54) CONTROLLER AND CONTROL METHOD FOR IMPROVING SIGNAL PERFORMANCE OF ION CYCLOTRON RESONANCE MASS SPECTROMETER

(75) Inventors: Seung Yong Kim, Daejeon (KR); Hyun Sik Kim, Daejeon (KR); Myoung Choul Choi, Chungbuk (KR); Jong Shin Yoo, Seoul (KR)

(73) Assignee: Korea Basic Science Institute, Daejeon (KR)

( * ) Notice: Subject to any disclaimer, the term of this patent is extended or adjusted under 35 U.S.C. 154(b) by 0 days.

(21) Appl. No.: 13/699,577

(22) PCT Filed: Oct. 31, 2011

(86) PCT No.: PCT/KR2011/008231
§ 371 (c)(1),
(2), (4) Date: Dec. 14, 2012

(87) PCT Pub. No.: WO2012/081826
PCT Pub. Date: Jun. 21, 2012

(65) Prior Publication Data

US 2013/0112864 A1 May 9, 2013

(30) Foreign Application Priority Data

Dec. 17, 2010 (KR) ..... 10-2010-0129681

(51) Int. Cl.
*H01J 49/02* (2006.01)

(52) U.S. Cl.
USPC ..... 250/291; 250/282; 250/290; 250/293

(58) Field of Classification Search
USPC ..... 250/291, 282, 290, 293
See application file for complete search history.

(56) References Cited

U.S. PATENT DOCUMENTS

| | | | | |
|---|---|---|---|---|
| 6,114,692 | A | 9/2000 | Beu | |
| 7,696,476 | B2 * | 4/2010 | Kim et al. | 250/291 |
| 2006/0027743 | A1 * | 2/2006 | Franzen et al. | 250/286 |
| 2007/0278402 | A1 * | 12/2007 | Zubarev et al. | 250/291 |
| 2008/0099672 | A1 * | 5/2008 | Kim et al. | 250/291 |
| 2009/0084948 | A1 * | 4/2009 | Baykut et al. | 250/282 |
| 2012/0267524 | A1 * | 10/2012 | Kim et al. | 250/283 |

FOREIGN PATENT DOCUMENTS

| | | | |
|---|---|---|---|
| JP | 2002-033072 | A | 1/2002 |
| KR | 10-0659263 | B1 | 12/2006 |
| KR | 10-0790532 | B1 | 1/2008 |

* cited by examiner

*Primary Examiner* — Nicole Ippolito
*Assistant Examiner* — Wyatt Stoffa
(74) *Attorney, Agent, or Firm* — Rabin & Berdo, P.C.

(57) ABSTRACT

Provided are a controller and a control method for improving signal performance of an ion cyclotron resonance mass spectrometer. The controller and control method apply electric signals for causing ions injected into an ion trap of the ion cyclotron resonance mass spectrometer to be injected to the center of the trap as close as possible to trap electrodes, and adjust biased ion motion by appropriately adjusting signals of trap electrodes for causing the injected ions to make ion motion, thereby improving the fidelity of ion signals. The control method for improving signal performance of an ion cyclotron resonance mass spectrometer includes an ion position adjustment process and an ion signal detection process.

2 Claims, 5 Drawing Sheets

CONTROLLER AND CONTROL METHOD FOR IMPROVING SIGNAL PERFORMANCE OF ION CYCLOTRON RESONANCE MASS SPECTROMETER

BACKGROUND

1. Field

The following description relates to an ion trap controller and a control method of an ion cyclotron resonance mass spectrometer, and more particularly, to a trap voltage controller and a control method that optimize an ion position adjustment process and ion motion for extending an ion lifetime to detect a signal of ions injected into an ion trap of an ion cyclotron resonance mass spectrometer.

2. Description of the Related Art

A controller of a general ion cyclotron resonance mass spectrometer will be described in detail below with reference to FIG. 1 and FIG. 2.

As shown in FIG. 1, a general ion cyclotron resonance mass spectrometer includes a sample injection and ionization unit 1 that ionizes an injected sample and releases ions, a first ion transport unit 2 that transports the ions released from the sample injection and ionization unit 1, an ion selection/separation unit 3 that selects or separates some of the ions transported through the first ion transport unit 2 according to a specific purpose and outputs the selected or separated ions, an ion collision unit 4 that causes the ions selected or separated by the ion selection/separation unit 3 to collide with a collision gas and thereby fragment the selected or separated ions into ions of a smaller size and output the fragmented ions, a second ion transport unit 5 that transports the ions fragmented by the ion collision unit 4, an ion trap 6 that collects the ions transported through the second ion transport unit 5 therein and then detects an electric signal representing the mass of the ions corresponding to the specific purpose, an arbitrary waveform generation (AWG) unit 8 that generates an arbitrary waveform by a control program of a computer 9 for signal detection of the ion trap 6, and a radio frequency (RF) amplifier (amp) 7 that amplifies the arbitrary waveform generated by the AWG unit 8, and excites the ions by applying the RF signal amplified by the RF amp 7 to the ion trap 6.

FIG. 2 is a block diagram showing a configuration of a circuit for an ion trap and signal transfer. The excited signal passes a pre-amplifier (pre-amp) 11 shown in FIG. 2 via an electrode of the ion trap 6 rather than a previous electrode to be amplified to an appropriate signal level, passes a digitizer (A/D) 10 to become a digital signal, and is processed in the computer 9.

The ions injected into the ion trap 6 in accordance with the related art make a circular motion in the shape of FIG. 3 due to the applied signal. Here, the more symmetrical with respect to the center of the trap the shape of the circular motion, the better the fidelity of the signal.

On the other hand, when the ion motion is made with a biased center, distortion of the signal occurs. To make ion motion symmetrical with respect to the center of the ion trap, ions need to be injected to the center of the ion trap, and a signal of the ion trap needs to be appropriate for the ion motion. An inappropriate signal causes biased ion motion, and thus signal distortion occurs.

SUMMARY

The present invention is directed to a controller and a control method for improving signal performance of an ion cyclotron resonance mass spectrometer, the controller and the control method applying an electric signal, which is intended to cause ions injected into an ion trap of the ion cyclotron resonance mass spectrometer to be injected as close to the center of the trap as possible, to a trap electrode, adjusting biased ion motion by appropriately adjusting a signal of the trap electrode for causing the injected ions to make ion motion, and thereby improving the fidelity of an ion signal.

According to an aspect of the present invention, there is provided a controller for improving signal performance of an ion cyclotron resonance mass spectrometer which adjusts positions of ions injected into an ion trap 6 by inputting radio frequency (RF) signals to first and second excitation electrodes 1-1 and 1-2 to cause the ions to make ion motion and applying control signals to first and second detection electrodes 2-1 and 2-2 for detecting ion signals by a control program of a computer 9, the controller including: an excitation electrode control means configured to selectively apply the RF signals from an RF amplifier (amp) 7 or control signals to the first and second excitation electrodes 1-1 and 1-2 for ion motion; a detection electrode control means configured to apply arbitrary waveforms generated from respective first and second control signal generators 21 and 23, which generate the control signals for ion motion, to the first and second detection electrodes 2-1 and 2-2, respectively; a detection electrode signal processing means configured to detect ion signals from the first and second detection electrodes 2-1 and 2-2, and amplify and convert the detected ion signals into digital signals; and an excitation electrode signal processing means configured to detect ion signals from the first and second excitation electrodes 1-1 and 1-2 by selection of a third excitation switch 15, and amplify and convert the detected ion signals into digital signals.

Here, the excitation electrode control means may include: third and fourth control signal generators 11 and 13 configured to generate and supply arbitrary waveforms to the first and second excitation electrodes 1-1 and 1-2 by the control program of the computer 9; a first excitation switch 12 configured to selectively output an RF signal from the RF amp 7 or a control signal from the third control signal generator 11 by the computer control program; a second excitation switch 14 configured to selectively output an RF signal from the RF amp 7 or a control signal from the fourth control signal generator 13 by the computer control program; and the third excitation switch 15 configured to apply the signals output from the first and second excitation switches 12 and 14 to the first and second excitation electrodes 1-1 and 1-2, respectively.

The detection electrode control means may include first and second detection switches 22 and 24 configured to apply the respective control signals generated from the first and second control signal generators 21 and 23 to the first and second detection electrodes 2-1 and 2-2, or detect ion signals from the first and second detection electrodes 2-1 and 2-2 and select the detected ion signals as outputs to the detection electrode signal processing means.

The detection electrode signal processing means includes: a second pre-amp 25 configured to amplify the ion signals output from the first and second detection switches 22 and 24; and a digitizer 26 configured to convert the ion signals amplified by the second pre-amp 25 into digital signals and output the digital signals to the computer 9.

The excitation electrode signal processing means nay include: a first pre-amp 16 configured to detect ion signals from the first and second excitation electrodes 1-1 and 1-2 and amplify the detected ion signals; and a first digitizer 17 configured to convert the ion signals amplified by the first pre-amp 16 into digital signals and output the digital signals to the computer 9.

According to another aspect of the present invention, there is provided a control process for improving signal performance of an ion cyclotron resonance mass spectrometer which adjusts positions of ions injected into an ion trap 6 by inputting RF signals to first and second excitation electrodes 2-1 and 2-2 to cause the ions to make ion motion and applying control signals to first and second detection electrodes 2-1 and 2-2 for detecting ion signals by a control program of a computer 9, the control method including: an ion position adjustment process of, when the ions are injected into the ion trap, applying control signals generated from first to fourth control signal generators driven by control of the computer to the first and second detection electrodes 2-1 and 2-2 and the first and second excitation electrodes 1-1 and 1-2 respectively so that the positions of the ions are adjusted to the center of the ion trap; an RF application process of applying the RF signals to the first and second excitation electrodes 1-1 and 1-2; and an ion signal detection process of detecting ion signals from the first and second detection electrodes 2-1 and 2-2.

The control process may further include, after the RF application process of applying the RF signals to the first and second excitation electrodes 1-1 and 1-2, a second ion position adjustment process of adjusting the positions of the ions by simultaneously applying the control signals from first and second control signal generators 21 and 22 to the first and second detection electrodes 2-1 and 2-2.

According to still another aspect of the present invention, there is provided a control process for improving signal performance of an ion cyclotron resonance mass spectrometer which adjusts positions of ions injected into an ion trap 6 by inputting radio frequency (RF) signals to first and second excitation electrodes 1-1 and 1-2 to cause the ions to make ion motion and applying control signals to first and second detection electrodes 2-1 and 2-2 for detecting ion signals by a control program of a computer 9, the control method including: an ion position adjustment process of, when the ions are injected into the ion trap, applying control signals generated from first to fourth control signal generators driven by control of the computer 9 to the first and second detection electrodes 2-1 and 2-2 and the first and second excitation electrodes 1-1 and 1-2 respectively so that the positions of the ions are adjusted to the center of the ion trap; an RF application process of applying the RF signals to the first and second excitation electrodes 1-1 and 1-2; and an ion signal detection process of detecting ion signals from the first and second detection electrodes 2-1 and 2-2.

Other objects, features and advantages will be apparent from the following description, the drawings, and the claims.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain aspects of the invention.

Elements, features, and structures are denoted by the same reference numerals throughout the drawings and the detailed description, and the size and proportions of some elements may be exaggerated in the drawings for clarity and convenience.

DETAILED DESCRIPTION

The detailed description is provided to assist the reader in gaining a comprehensive understanding of the methods, apparatuses and/or systems described herein. Various changes, modifications, and equivalents of the systems, apparatuses, and/or methods described herein will likely suggest themselves to those of ordinary skill in the art. Also, descriptions of well-known functions and constructions are omitted to increase clarity and conciseness.

Hereinafter, a controller and a control method for improving signal performance of an ion cyclotron resonance mass spectrometer according to exemplary embodiments of the present invention will be described in detail with reference to the accompanying FIGS. 4 and 5.

Figure 1:
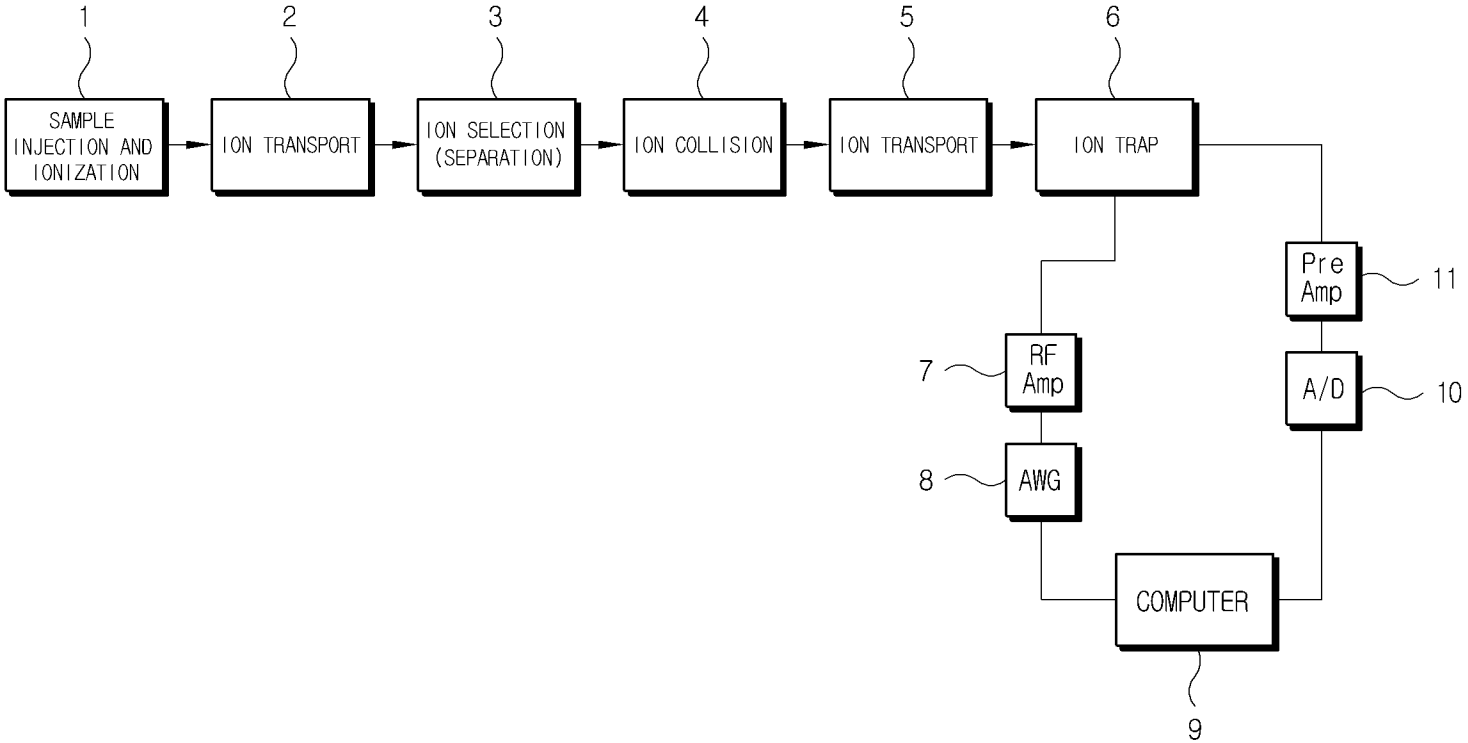
FIG. 1 is a block diagram showing a configuration of a general ion cyclotron resonance mass spectrometer.
Figure 2:
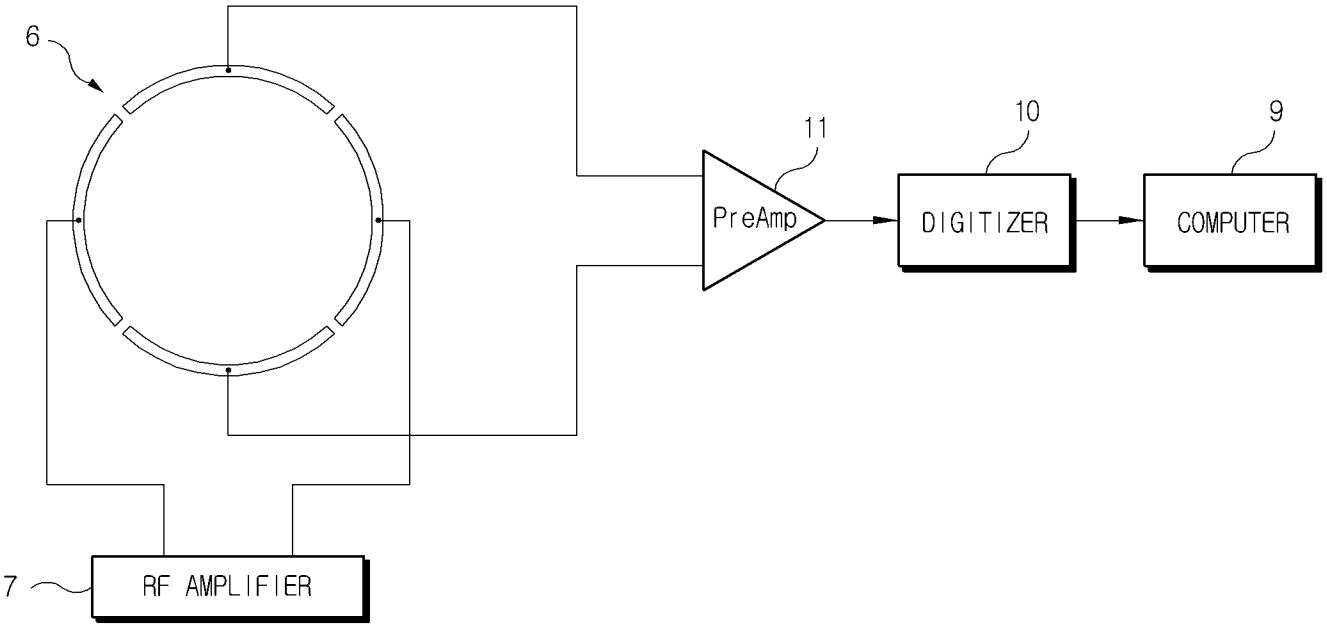
FIG. 2 is a block diagram showing a configuration of an ion trap and a signal transfer device of an ion cyclotron resonance mass spectrometer according to related art.
Figure 3:
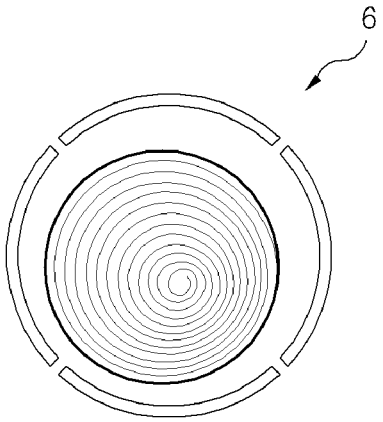
FIG. 3 shows a circular motion of ions injected into an ion trap according to related art.
Figure 4:
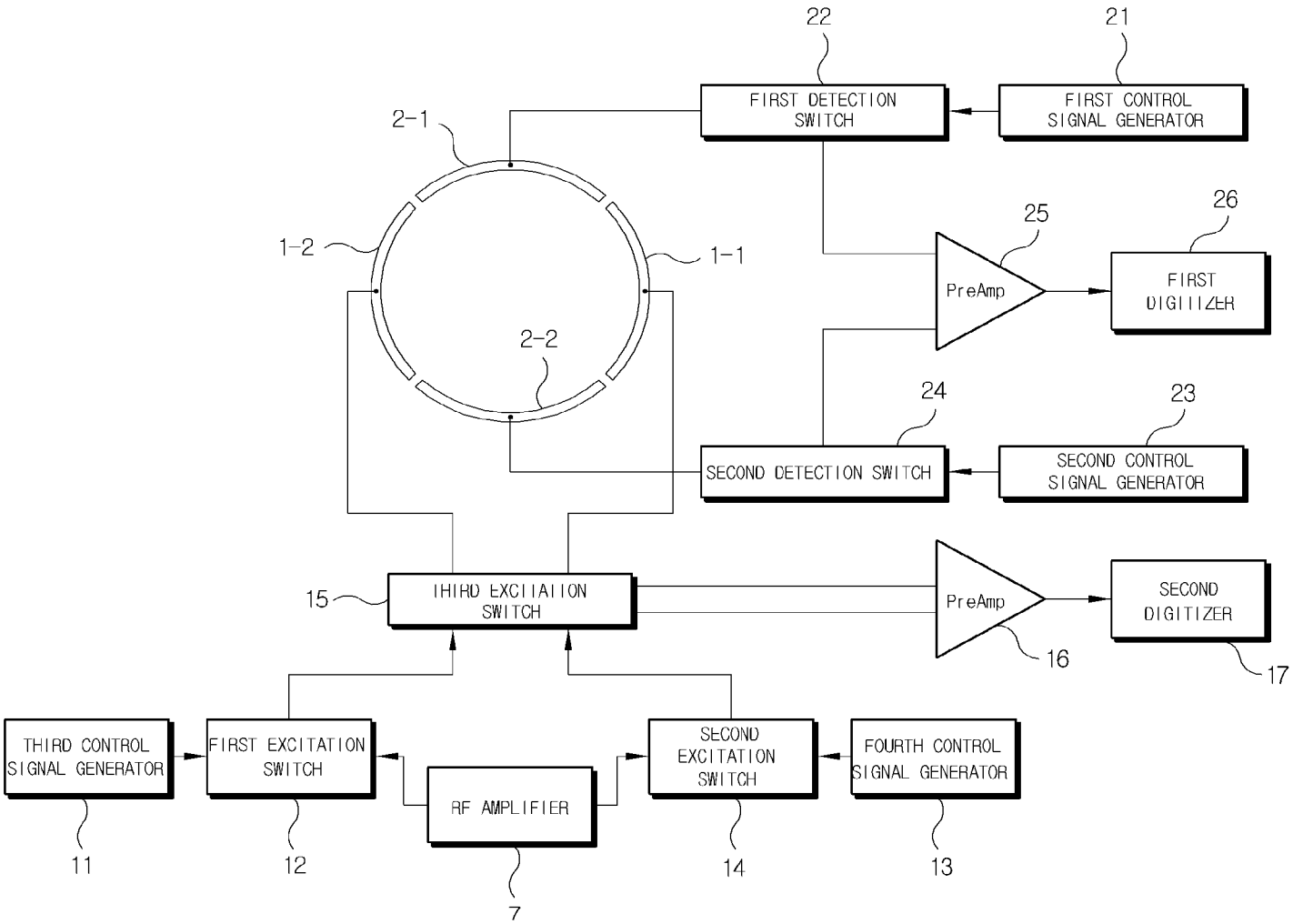
FIG. 4 is a block diagram showing a constitution of a controller for improving signal performance of an ion cyclotron resonance mass spectrometer according to an exemplary embodiment of the present invention.

FIG. 4 is a block diagram showing a constitution of a controller for improving signal performance of an ion cyclotron resonance mass spectrometer according to an exemplary embodiment of the present invention. The controller includes: an ion trap 6 that includes first and second excitation electrodes 1-1 and 1-2 and first and second detection electrodes 2-1 and 2-2 so that injected ions make ion motion due to control signals and radio frequency (RF) signals applied by a control program of a computer 9; third and fourth control signal generators 11 and 13 that generate and supply arbitrary waveforms to the first and second excitation electrodes 1-1 and 1-2 by the control program of the computer 9; a first excitation switch 12 that selectively outputs an RF signal generated from an RF amplifier (amp) 7 or a control signal from the third control signal generator 11 by the computer control program; a second excitation switch 14 that selectively outputs an RF signal generated from the RF amp 7 or a control signal from the fourth control signal generator 13 by the computer control program; a third excitation switch 15 that applies the signals output from the first and second excitation switches 12 and 14 to the first and second excitation electrodes 1-1 and 1-2, respectively; a first pre-amp 16 that detects ion signals from the first and second excitation electrode 1-1 and 1-2 by selection of the third excitation switch 15 and amplifies the detected ion signals; a second digitizer 17 that converts the ion signal amplified through the first pre-amp 16 into a digital signal and outputs the digital signal to the computer 9; first and second detection switches 22 and 24 that select application of respective control signals generated from first and second control signal generators 21 and 23 to the first and second detection electrodes 2-1 and 2-2 or detection of ion signals from the first and second detection electrodes 2-1 and 2-2; a second pre-amp 25 that amplifies ion signals detected by the first and second detection switches 22 and 24; and a first digitizer 26 that converts the ion signals amplified by the second pre-amp 25 into digital signals and outputs the digital signals to the computer 9.

Operation of the controller for improving signal performance of an ion cyclotron resonance mass spectrometer with this constitution according to an exemplary embodiment of the present invention will be described in detail below.

In a first method according to an exemplary embodiment of the present invention, when ions are injected into the ion trap 6, signals are applied to the respective electrodes 2-1, 2-2, 1-2 and 1-1 by control signals applied from the first to fourth control signal generators 21, 23, 11 and 13, so that positions of the ions are adjusted. After that, as RF signals are applied to the first and second excitation electrodes 1-1 and 1-2, ion signals are detected by the first and second detection electrodes 2-1 and 2-2.

In a second method, when ions are injected into the ion trap 6, signals are applied to the respective electrodes 2-1, 2-2, 1-2 and 1-1 by control signals applied from the first to fourth control signal generators 21, 23, 11 and 13, so that positions of the ions are adjusted. After that, RF signals (including a direct current (DC) offset) are applied to the first and second excitation electrodes 1-1 and 1-2, and respective control signals are simultaneously applied to the first and second detection electrodes 2-1 and 2-2, so that the positions of the ions are adjusted. After that, ion signals are detected by the first and second detection electrodes 2-1 and 2-2.

In a third method, after ions are injected into the ion trap 6, RF signals (including a DC offset) are applied to the first and second excitation electrodes 1-1 and 1-2, and respective control signals are simultaneously applied to the first and second detection electrodes 2-1 and 2-2, so that positions of the ions are adjusted. After that, ion signals are detected by the first and second detection electrodes 2-1 and 2-2.

Operation of the respective parts for implementing the three control methods will be described in detail below.

As the computer 9 individually drives and controls the first and second control signal generators 21 and 23, the third and fourth control signal generators 11 and 13, and the selection switches 12, 14, 15, 22 and 24, control signals are respectively applied to the first excitation electrodes 1-1 and 1-2 and the first and second detection electrodes 2-1 and 2-2 to adjust positions of ions that are injected into the ion trap 6 and move.

In other words, to adjust positions of ions injected into the ion trap 6, control signals should be applied to the respective four electrodes 1-1, 1-2, 2-1 and 2-2.

Here, DC voltages applied to the respective electrodes 1-1, 1-2, 2-1 and 2-2 according to bias of the ions or a magnitude of a square wave kept for a predetermined time may be used as the control signals generated from the first to fourth control signal generators 21, 23, 11 and 13, and scanned sine waves that have a start frequency and an end frequency are frequently used as the RF signals.

More specifically, a control signal of the fourth control signal generator 13 is applied to the first excitation electrode 1-1 by selection of the second and third excitation switches 14 and 15, and a control signal of the third control signal generator 11 is applied to the second excitation electrode 1-2 by selection of the first and third excitation switches 12 and 15.

On the other hand, a control signal of the first control signal generator 21 is applied to the first detection electrode 2-1 through the first detection switch 22, and a control signal of the second control signal generator 23 is applied to the second detection electrode 2-2 through the second detection switch 24.

The RF signals are applied to the ions introduced in the ion trap 6. Here, two RF signals having a phase difference of 180 degrees are output from the RF amp 7 and respectively applied to the first and second excitation electrodes 1-1 and 1-2 through the first and second excitation switches 12 and 14.

A DC offset voltage may be applied to the RF signals applied to the first and second excitation electrodes 1-1 and 1-2 according to necessity. In other words, the necessary control signals are applied to the first and second detection electrodes 2-1 and 2-2 in the ion trap 6 at the same time when the RF signals are applied to the first and second excitation electrodes 1-1 and 1-2.

The control signal is generated from the first control signal generator 21 and applied to the first detection electrode 2-1 by selection of the first detection switch 22, and the control signal generated from the second control signal generator 23 is applied to the second detection electrode 2-2 by selection of the second detection switch 24.

After the necessary signals are applied to the respective four electrodes 1-1, 1-2, 2-1 and 2-2 in this way, a signal from the first detection electrode 2-1 is input to one terminal of the pre-amp 25 by selection of the first detection switch 22, and a signal from the second detection electrode 2-2 is input to the other terminal of the pre-amp 25 by selection of the second detection switch 24, so that signal amplification is performed. The amplified signals are converted into digital signals through the first digitizer 26 and then transmitted to the computer 9.

When another digitizer channel is also used, signals from the first and second excitation electrodes 1-1 and 1-2 are input to two terminals of the second pre-amp 16 and amplified by selection of the third excitation switch 15, converted into digital signals through the second digitizer 17, and transmitted to the computer 9.

Figure 5:
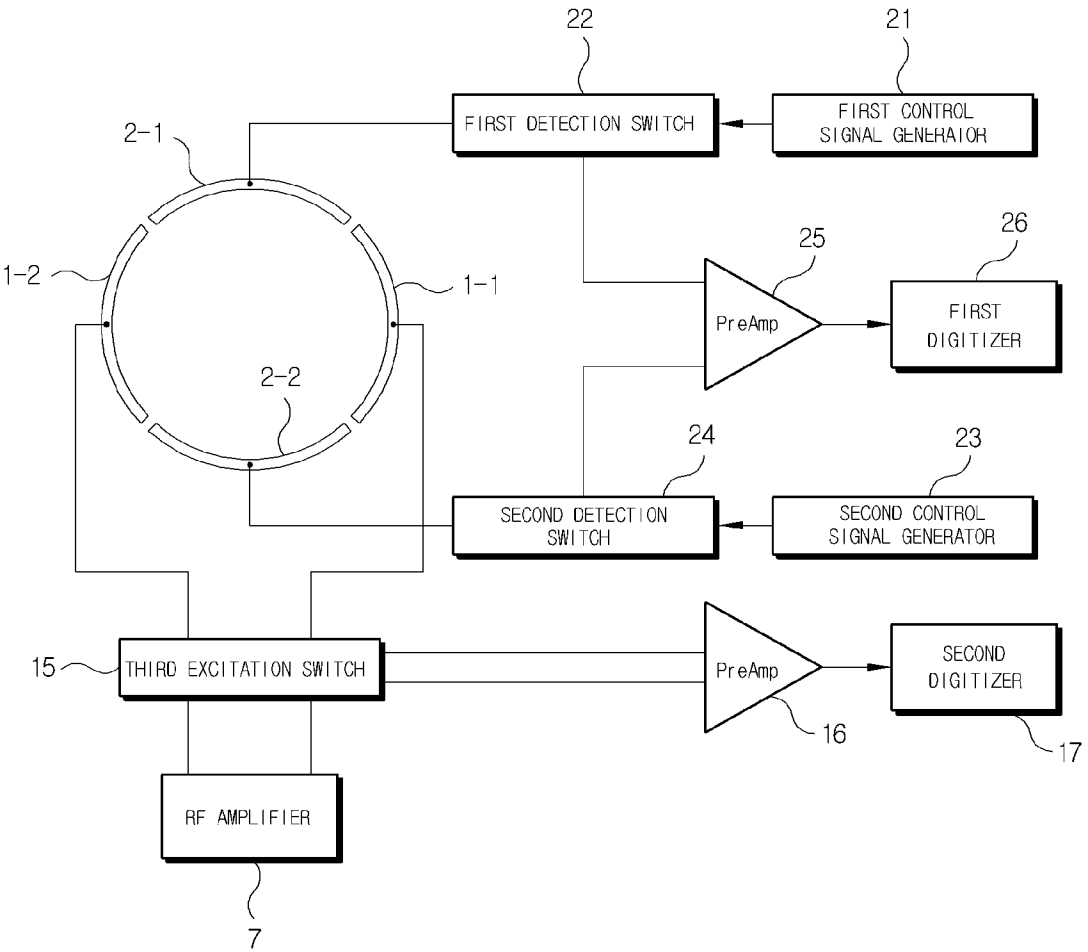
FIG. 5 is a block diagram showing a constitution of a controller for improving signal performance of an ion cyclotron resonance mass spectrometer according to another exemplary embodiment of the present invention.

FIG. 5 is a block diagram showing a constitution of a controller for improving signal performance of an ion cyclotron resonance mass spectrometer according to another exemplary embodiment of the present invention. The constitution is intended to apply control signals to first and second detection electrodes 2-1 and 2-2 while applying RF signals to ions injected into an ion trap 6 without the procedure of applying RF signals after application of control signals, unlike the constitution of FIG. 4.

In other words, RF signals amplified by an RF amp 7 are applied to first and second excitation electrodes 1-1 and 1-2 through a third excitation switch 15, and simultaneously, control signals generated from first and second control signal generators 21 and 23 are applied to the first and second detection electrodes 2-1 and 2-2 through first and second detection switches 22 and 24, so that positions of ions are adjusted.

Here, the RF signals applied to the first and second excitation electrodes 1-1 and 1-2 include a DC offset.

After that, ion signals are detected from the first and second detection electrodes 2-1 and 2-2, applied to and amplified by a first pre-amp 25 through the first and second detection switches 22 and 24, and then input to a first digitizer 26.

On the other hand, when ion signals are detected, ion signals detected from the first and second excitation electrodes 1-1 and 1-2 through the third excitation switch 15 are amplified through a second pre-amp 16, and the amplified ion signals are transmitted to a computer 9.

A controller for improving signal performance of an ion cyclotron resonance mass spectrometer according to exemplary embodiments of the present invention can adjust positions of injected ions to the center of a trap when the ions are biased, and also enables correction of positional bias when voltage for ion motion is supplied. Thus, it is possible to extend the lifetime of ions in the trap, and ion motion can be smoothly made to improve signal sensitivity.

It will be apparent to those of ordinary skill in the art that various modifications can be made to the exemplary embodiments of the invention described above. However, as long as modifications fall within the scope of the appended claims and their equivalents, they should not be misconstrued as a departure from the scope of the invention itself.

What is claimed is:

1. A control method for improving signal performance of an ion cyclotron resonance mass spectrometer which adjusts positions of ions injected into an ion trap by inputting radio frequency (RF) signals to first and second excitation electrodes to cause the ions to make ion motion and applying control signals to first and second detection electrodes for detecting ion signals by a control program of a computer, the control method comprising:

a first ion position adjustment process of, when the ions are injected into the ion trap, applying control signals generated from first to fourth control signal generators driven by control of the computer to the first and second detection electrodes and the first and second excitation electrodes respectively so that the positions of the ions are adjusted to a center of the ion trap;

an RF application process of applying the RF signals to the first and second excitation electrodes;

a second ion position adjustment process of adjusting the positions of the ions by simultaneously applying the control signals from first and second control signal generators to the first and second detection electrodes after the RF application process of applying the RF signals to the first and second excitation electrodes; and an ion signal detection process of detecting ion signals from the first and second detection electrodes.

2. The control method of claim 1, wherein the first ion signal detection process further includes detecting ion signals from the first and second excitation electrodes by control of the computer, amplifying and converting the ion signals into digital signals, and then outputting the digital signals to the computer.

* * * * *